US008365749B2

(12) United States Patent
Overbaugh

(10) Patent No.: US 8,365,749 B2
(45) Date of Patent: Feb. 5, 2013

(54) COLLAPSIBLE HUNTING BLIND

(76) Inventor: Anthony D. Overbaugh, Winchester, VA (US)

( * ) Notice: Subject to any disclaimer, the term of this patent is extended or adjusted under 35 U.S.C. 154(b) by 85 days.

(21) Appl. No.: 12/840,068

(22) Filed: Jul. 20, 2010

(65) Prior Publication Data

US 2011/0017251 A1 Jan. 27, 2011

Related U.S. Application Data

(60) Provisional application No. 61/271,348, filed on Jul. 21, 2009.

(51) Int. Cl.
*E04H 15/04* (2006.01)
*E04H 15/40* (2006.01)
*E04H 15/44* (2006.01)

(52) U.S. Cl. ..... 135/90; 135/125; 135/136; 135/901; 135/906

(58) Field of Classification Search ..... 135/90, 135/124, 127, 136, 120.4, 906, 901; 52/83; 5/414

See application file for complete search history.

(56) References Cited

U.S. PATENT DOCUMENTS

| | | | | | |
|---|---|---|---|---|---|
| 363,096 | A * | 5/1887 | Travers | 5/123 |
| 1,156,200 | A * | 10/1915 | Ashworth | 5/121 |
| 1,285,791 | A * | 11/1918 | Purcell | 135/136 |
| 1,401,846 | A * | 12/1921 | Wiles | 5/121 |
| 1,560,114 | A * | 11/1925 | Skog | 135/124 |
| 3,800,814 | A * | 4/1974 | Hibbert | 135/93 |
| 4,001,902 | A * | 1/1977 | Hall et al. | 5/121 |
| 5,487,402 | A * | 1/1996 | Clary | 135/87 |
| 2002/0029528 | A1 * | 3/2002 | Kendro, Jr. | 52/4 |

* cited by examiner

*Primary Examiner* — David Dunn
*Assistant Examiner* — Danielle Jackson
(74) *Attorney, Agent, or Firm* — Birch, Stewart, Kolasch & Birch, LLP

(57) ABSTRACT

A hunting blind is made of lightweight material allowing the hunting blind to be collapsed and folded or rolled into a compact configuration. The compact configuration allows the easy storage and transportation of the hunting blind. The hunting blind may easily be carried by one person to any desired location and temporarily set up. In this manner, the hunter can place the blind anywhere, rather than building a blind of more permanent material, such as wood, but then being restricted to the one location where the blind is built. Cords attached to two sides of the blind create tension in the blind, causing flexible rods at the top of the side to bend into an arcuate shape. The rods then create an arched roof, providing increased head room in the blind and preventing accumulation of debris and rain water on the roof.

8 Claims, 2 Drawing Sheets

COLLAPSIBLE HUNTING BLIND

This application is a continuation of provisional application 61/271,348, filed on Jul. 21, 2009.

BACKGROUND OF THE INVENTION

Hunting is an activity enjoyed by thousands of people and a tradition passed down from generation to generation. Many different types of game are hunted, each having its own season. Different methods are employed depending on the type of game being pursued and each hunting method uses its own type of equipment and methods.

Some game requires the hunter to be moving while other game is better suited for the hunter to be stationary. When stationary, a hunting blind is often used. Duck hunting is one type of hunting often utilizing a blind. The hunting blind provides both shelter and camouflage for the hunter. The hunting blind also provides a place to keep supplies.

Often, the hunting blind is a permanent structure, built of wood and not easily moved form one location to another. Therefore, the hunter must choose where to place the blind in a location he believes will afford good hunting, not only in the immediate future, but for the long term. Once constructed, the hunter is limited to hunting in the immediate area around the blind.

SUMMARY OF THE INVENTION

A hunting blind is made of lightweight material allowing the hunting blind to be collapsed and folded or rolled into a compact configuration. The compact configuration allows the easy storage and transportation of the hunting blind. The hunting blind may easily be carried by one person to any desired location and temporarily set up. In this manner, the hunter can place the blind anywhere, rather than building a blind of more permanent material, such as wood, but then being restricted to the one location where the blind is built. Cords attached to two sides of the blind create tension in the blind, causing flexible rods at the top of the side to bend into an arcuate shape. The rods then create an arched roof, providing increased head room in the blind and preventing accumulation of debris and rain water on the roof.

There is a need in the art for a portable, collapsible blind that can be moved from one location to another. The blind needs to be lightweight, sturdy and easily set up and taken down.

A collapsible hunting blind includes a top wall, the top wall having a front edge, a rear edge, a left side edge and a right side edge, side walls suspended from the top wall, the sidewalls including a front side wall attached to the top wall front edge, a rear side wall attached to the top wall rear edge, a left side wall attached to the top wall left side edge, a right side wall attached to the top wall right side edge, a first support rod attached proximate the top wall front edge, a second support rod attached proximate the top wall rear edge, a first support rod attached proximate the top wall front edge, a second support rod attached proximate the top wall rear edge, a first strap connected to the front corners of the top wall, and a second strap connected to the rear corners of the top wall.

A first sleeve extends along the top wall front edge, the first support rod being placed within the first sleeve and a second sleeve extends along the top wall rear edge, the second support rod being placed within the second sleeve. The first support rod and second support rod may be permanently fixed. The first support rod and second support rod may be arcuate. An entrance in the front wall allows persons to enter and exit the blind and there may be a ventilation opening in the top wall.

DETAILED DESCRIPTION OF THE INVENTION

The hunting blind 10 is lightweight and portable. The hunting blind is constructed of any suitable material, such as nylon. Preferably the material is waterproof but allows the passage of air to allow circulation in the hunting blind. The hunting blind may be rolled up or folded into a compact configuration for storage or transportation. The blind may have any pattern, such as any conventional camouflage patterns or may be a solid color, as warranted by the intended use of the hunting blind.

Figure 1:
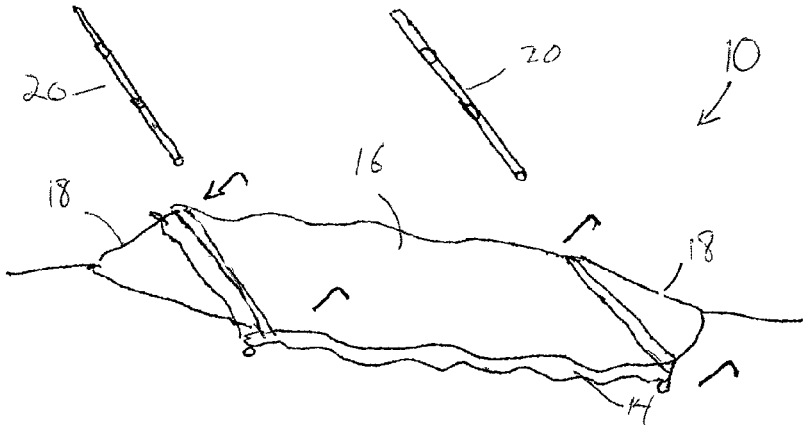
FIG. 1 is a perspective view of the hunting blind in a collapsed condition.

FIG. 1 depicts the hunting blind 10 transported to its final destination where it will be erected. The walls are a lightweight, flaccid material and the blind may be set out on the ground to ensure that the chosen location can accommodate the length and width of the blind.

Once a suitable location is chosen, the blind is erected by first raising the walls. The walls include a front wall 12 having an access opening allowing persons to enter and exit the blind. The front wall defines the width of the blind. Sidewalls 14 extend from the front wall 12 and defines the length of the blind. The blind may have a floor, but the provision of a floor requires that the top wall be suspended from the correct height to have the floor on the ground. Without a floor, the bottom edges of the sidewalls are free edges.

Figure 2:
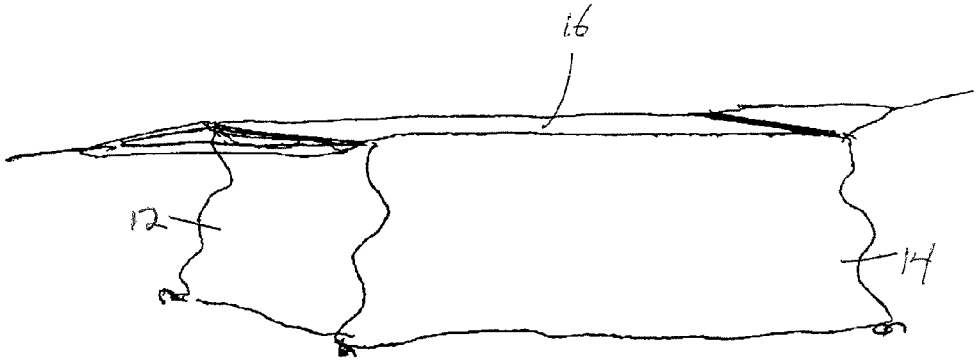
FIG. 2 is a view of the hunting blind in a partially assembled condition.

As can be seen in FIG. 2, the top wall 16 extends between the sidewalls, front wall and back wall. A cord 18 attaches to both upper corners of the front wall, at the junction with the sidewalls and top wall. A second cord attaches to both upper corners of the back wall. The cord may be V-shaped or may connect to a common cord to assume a Y-shape.

A flexible support rod 20 extends along the top edge of the front wall and back wall. The flexible support rod may be made of any suitable material, such a fiberglass, carbon fiber or any other material having sufficient strength and flexibility to achieve its intended purpose. The flexible support rod may be permanently or removably attached in any suitable manner. For example, a sleeve may be formed along the top edge of the front wall and the back wall, with the flexible support rod slid into an open end of the sleeve. Instead of a sleeve, a series of rings may retain the flexible support rod. Also, the flexible support rod may be sewn onto the front wall and back wall. Additional flexible members may be used between the sidewalls walls. The rod needs to be proximate the junction of the top wall with the front wall and the rear wall.

One of the cords 18 is attached to a high anchor point, such as a tree, and secured. Then the other cord 18 is applied to another high anchor point and tension is applied to the cord. Tension is created in the cord by applying force to the cord and then securing the cord in place to maintain the pressure. Many types of buckles are known in the prior art for creating and maintaining tension in a cord. The tension has the effect of trying to increase the length of the hunting blind. Because the cord extending form each anchor point converge, the tension urges the two top corners toward one another, effectively reducing the overall width of the hunting blinds. Because the flexible support rod is secured to the top edge of the front and back walls, the tension causes the flexible members to bend into an arch. The flexible members then cause the top wall 16 to arch between the sidewalls, as seen in FIG. 3.

There may also be a cord attached to the middle of the top wall edge to ensure that the support rod assumes and maintains a vertical orientation.

Preferably, the blind uses trees as an anchor point and the top wall extends between the support rods, much like a hammock. By using trees as anchor points for support the blind, only two support rods are necessary and the blind can be made very large and still be lightweight. This design allows the blind to be large enough to cover a full sized ATV or accommodate handicapped or wheelchair bound hunters, several hunters at the same time such as a family, group, hunter and camera man. The sidewalls extend downward from the top wall. The sidewalls hang freely. To prevent the movement of the sidewalls due to wind or other forces, straps 22 attached to the bottom edge of the sidewalls can be anchored to the ground. The straps can be secured to the ground with stakes before the top wall is lifted into position. Grommets 23 can be used in addition to, or in place of, the straps as a way to secure the bottom edge of the sidewalls to the ground. The grommets 23 can extend up the sidewall to provide multiple anchor points that may be needed on uneven ground, causing the sidewall to contact the ground at a point spaced above the bottom edge.

The arched top had several advantages. It affords greater height of the hunting blind to provide more headroom for the users of the hunting blind. In addition, the arched top prevents the accumulation of rain water, leaves, braches and other debris that falls onto the hunting blind. The top may be provided with at least one ventilation holes 24. Preferably, the ventilations hole is formed by a movable flap secured to the top wall in any suitable manner, such as a zipper. In this way, the ventilation hole may be selectively opened and closed. To increase ventilation and visibility, the sidewalls may have at least one window 26. Similar to the ventilation hole, the window may be selectively closed by a flap secured to the sidewall in any suitable manner, such as with a zipper or ties.

Figure 3A:
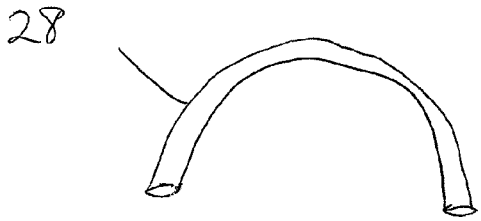
FIG. 3*a* is a view of an arcuate support rod.
Figure 3:
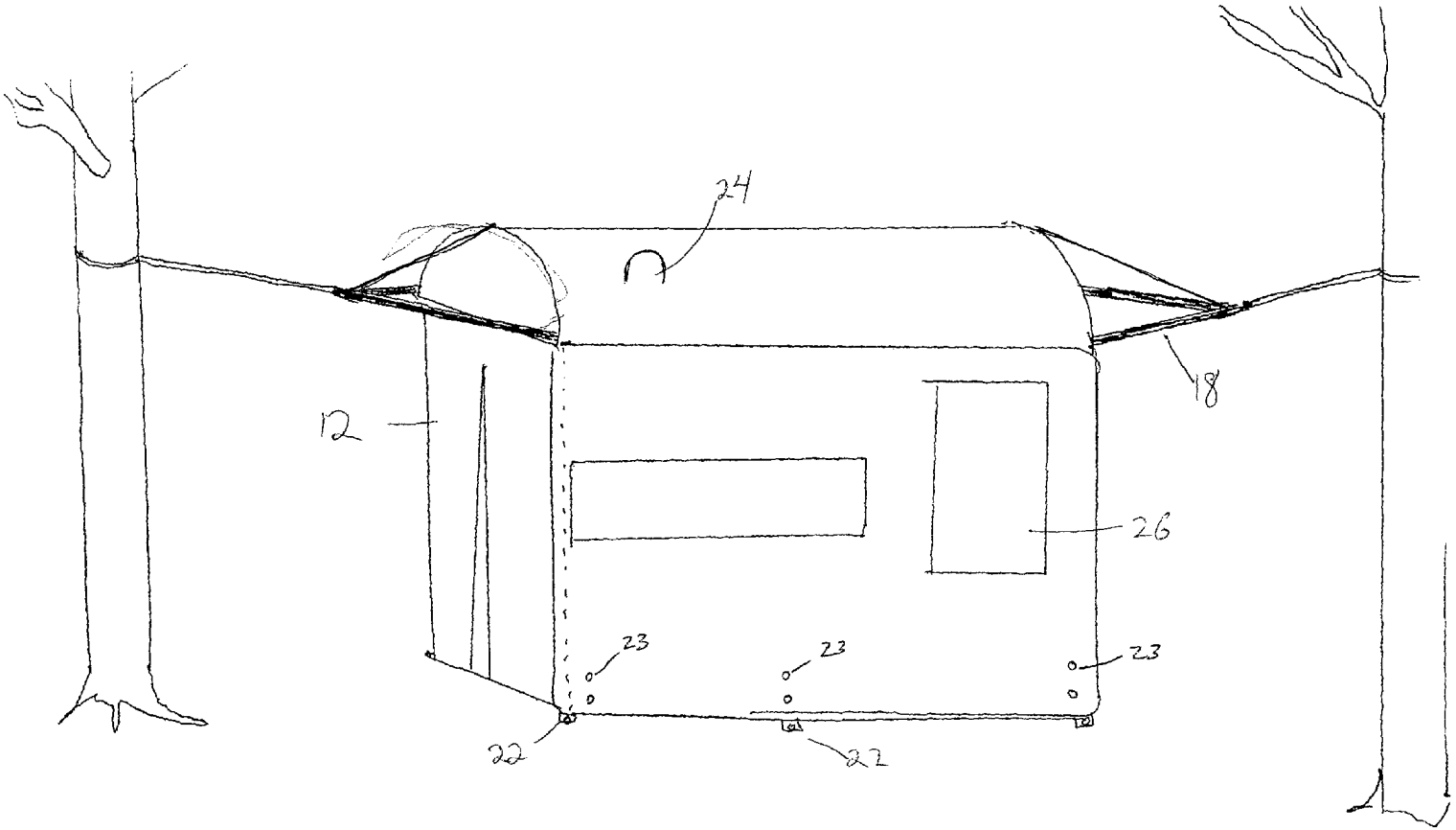
FIG. 3 is a view of the hunting blind in a fully assembled position having an arched roof.

In place of a straight flexible support rod that is arched when tension is applied to the cords 18, a flexible resilient arcuate support rod 28 may be used at the junction of the top wall with the front and back walls, as depicted in FIG. 3A. Once the arcuate support rod is attached to the top edges of the front and back walls, either permanently or removably, the top wall will assume an arched shape.

While the invention has been described with reference to a preferred embodiment, variations and modification would be apparent to one of ordinary skill in the art. The invention encompasses such variations and modifications.

I claim:

1. A collapsible hunting blind, comprising:

a top wall, the top wall having a front edge, a rear edge, a left side edge and a right side edge;

side walls suspended from the top wall, the sidewalls comprising:

a front side wall attached to the top wall front edge; and a rear side wall attached to the top wall rear edge;

a left side wall attached to the top wall left side edge;

a right side wall attached to the top wall right side edge;

a first front corner proximate the junction of the top wall with the front side wall and the left side wall;

a second front corner proximate the junction of the top wall with the front side wall and the right side wall;

a first rear corner proximate the junction of the top wall with the rear side wall and the left side wall;

a second rear corner proximate the junction of the top wall with the rear side wall and the right side wall;

a first flexible support rod attached proximate the top wall front edge, a length of the first support rod being equal to a length of the top wall front edge and having two free ends;

a second flexible support rod attached proximate the top wall rear edge, a length of the second support rod being equal to a length of the top wall rear edge and having two free ends;

a first strap connected to two points, each point proximate to one of the front corners; and a second strap connected to two points, each point proximate to one of the rear corners, wherein tension applied to the first and second strap causes the first support rod and second support rod to move from a straight configuration to an arched configuration.

2. The hunting blind of claim 1, further comprising a first sleeve extending along the top wall front edge, the first support rod placed within the first sleeve; and a second sleeve extending along the top wall rear edge, the second support rod placed within the second sleeve.

3. The blind of claim 1, wherein the first support rod and second support rod are permanently fixed to the top wall.

4. The blind of claim 1, further comprising:

an entrance in the front wall allowing persons to enter and exit the blind.

5. The blind of claim 1, further comprising:

a ventilation opening in the top wall.

6. The blind of claim 1, further comprising straps at a bottom edge of the sidewalls to secure the sidewalls to the ground.

7. The blind of claim 1, wherein the bottom edge of the side walls are free edges.

8. A collapsible hunting blind, comprising:

a top wall, the top wall having a front edge, a rear edge, a left side edge and a right side edge;

side walls suspended from the top wall, the sidewalls comprising:

a front side wall attached to the top wall front edge;

a rear side wall attached to the top wall rear edge;

a left side wall attached to the top wall left side edge;

a right side wall attached to the top wall right side edge;

a first front corner proximate the junction of the top wall with the front side wall and the left side wall;

a second front corner proximate the junction of the top wall with the front side wall and the right side wall;

a first rear corner proximate the junction of the top wall with the rear side wall and the left side wall;

a second rear corner proximate the junction of the top wall with the rear side wall and the right side wall;

a first support rod attached proximate the top wall front edge, a length of the first support rod being equal to a length the top wall front edge and having two free ends;

a second support rod attached proximate the top wall rear edge, a length of the second support rod being equal to a length of the top wall rear edge and having two free ends;

a first strap connected to two points, each point proximate to one of the front corners; and a second strap connected to two points, each point proximate to one of the rear corners, the top wall having a first position wherein the top wall is substantially planar and a second configuration wherein the top wall is arched, the top wall moving from the first configuration to the second configuration when tension is applied to the first and second straps to cause the first and second support rods to move from a straight configuration to an arched configuration.

* * * * *